United States Patent [19]

Jawdat

[11] Patent Number: 4,461,203

[45] Date of Patent: Jul. 24, 1984

[54] BREECH-LOCKING MECHANISM FOR FIREARMS

[76] Inventor: Nameer A. Jawdat, 8609 Brandt Pl., Bethesda, Md. 20814

[21] Appl. No.: 396,203

[22] Filed: Jul. 8, 1982

[30] Foreign Application Priority Data

Jul. 10, 1981 [IT] Italy ..... 48876 A/81

[51] Int. Cl.[3] ..... F41D 3/00; F41D 3/04; F41D 5/12

[52] U.S. Cl. ..... 89/154; 89/4.5; 89/181; 89/183; 89/191 R; 89/196

[58] Field of Search ..... 89/186, 180–183, 89/184, 187, 194–197, 154, 4.5, 4 R, 191 R

[56] References Cited

U.S. PATENT DOCUMENTS 1,391,496 9/1921 Pedersen ..... 89/184 X
1,418,021 5/1922 Reifgraber ..... 89/191 X
1,550,759 8/1925 Swebilius ..... 89/184
3,153,982 10/1964 Seifried ..... 89/183 X
3,566,745 10/1968 Jauch ..... 89/183 X

FOREIGN PATENT DOCUMENTS 702756 2/1941 Fed. Rep. of Germany ..... 89/184

*Primary Examiner*—Donald G. Kelly
*Attorney, Agent, or Firm*—Sughrue, Mion, Zinn, Macpeak and Seas

[57] ABSTRACT

A device for loading and firing semi-automatic arms, particularly pistols, and comprising a plurality of follower lugs or pins carried in the slide, and a corresponding plurality of inclined grooves carried in the yoke and engaged by the lugs or pins so as to disengage the yoke and the bolt from the barrel when the slide is retracted under the pressure of the gases from a fired cartridge.

6 Claims, 15 Drawing Figures

FIG. 1
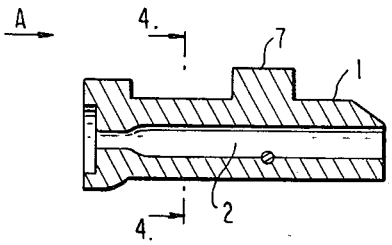
FIG. 2
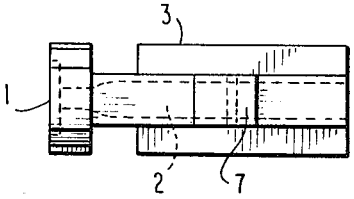
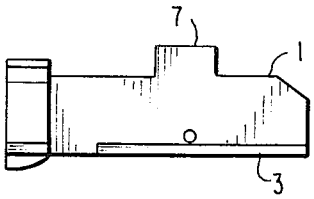
FIG. 3
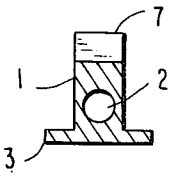
FIG. 4
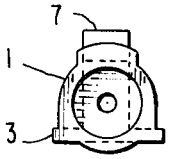
FIG. 5
FIG. 6
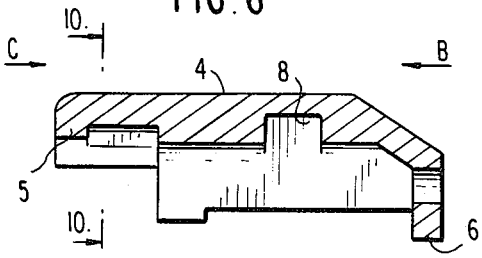
FIG. 7
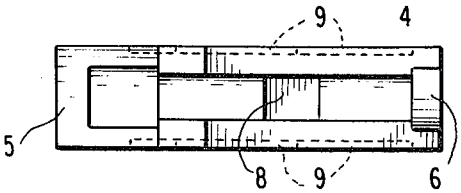
FIG. 9
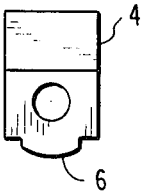
FIG. 10
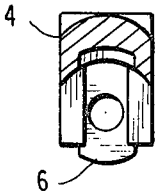
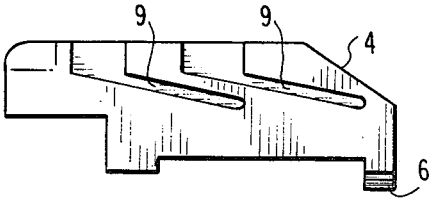
FIG. 8
FIG. 11
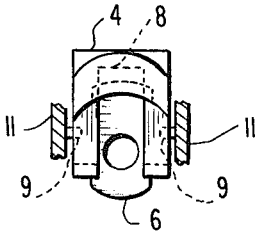

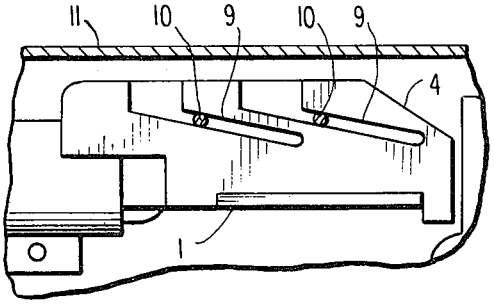
FIG. 12
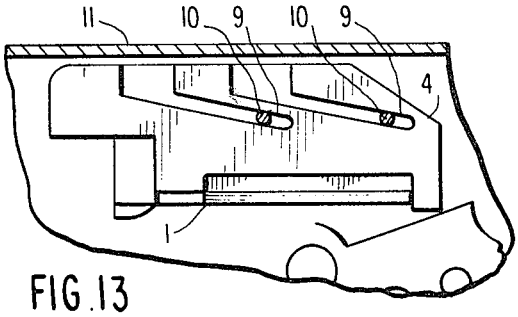
FIG. 13
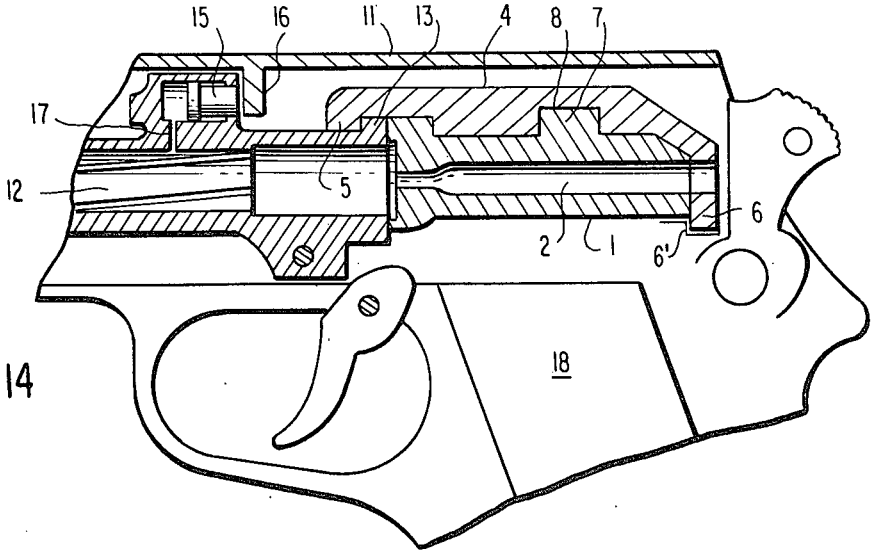
FIG. 14
FIG. 15
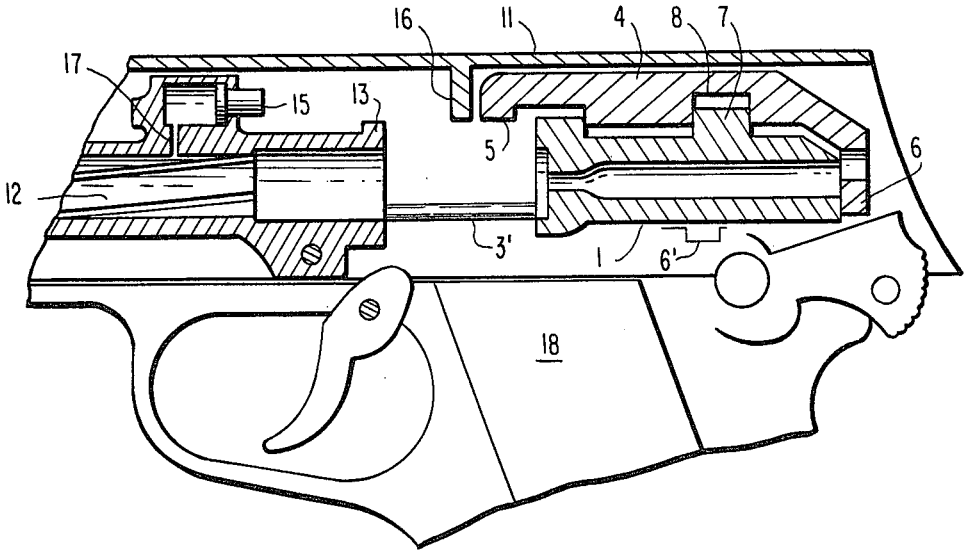

BREECH-LOCKING MECHANISM FOR FIREARMS

BACKGROUND OF THE INVENTION

The present invention relates to the field of firearms and, more particularly, to an improved device for the loading and firing of a pistol and having means providing double locking of the bolt with respect to the barrel.

The locking mechanism for the breech of a firearm using a cartridge powerful enough to require a locked breech is generally actuated by one of three methods:

(1) Short recoil: The barrel and breech bolt recoil together for a short distance, typically about three millimeters, by which time the bullet has left the barrel and the gas pressure has subsided, and at which time the two components are separated from each other by a cam, and the slide/bolt, typically one piece, is free to recoil independently, cock the firing mechanism, eject the spent cartridge case and chamber a new one in readiness for another shot. Most pistols firing cartridges more powerful than those falling in the "pocket pistol" category fall into this classification, and many are variants of the designs of John M. Browning. Many of these designs are functional and reliable, but have the drawback of being excessively bulky and heavy. When a manufacturer wants to make a lighter version of a pistol of this type, he is forced to make the frame of light alloy, which is neither as durable nor as easy to machine as steel.

(2) Long recoil: The barrel recoils with the bolt for the extent of its travel, thereby cocking the firing mechanism; then, the barrel is released and goes forward independently, ejecting the spent cartridge case; and, then, the bolt goes forward, chambering a fresh cartridge in readiness for another shot. Though this mechanism is common in shotguns, it has no advantages in pistol design, and no successful examples.

(3) Gas operation: The barrel, which is rigidly fixed to the frame, typically contains a small hole leading to a cylinder. On firing a shot, a part of the gas under pressure is bled into the cylinder and expands against a piston that operates the bolt. There are many examples of gas-operated rifles and shotguns, but no current production pistols, the principal reason being that previous designs depended on a rotating bolt with lugs to lock the breech. A rotating bolt with protruding lugs is not a drawback when used on a rifle or shotgun, where there is room for a certain amount of thickness at the breech, but, if bulk is an important consideration when laying down the parameters of a design, it is a serious drawback, and previous designs have not proved to be an improvement on more conventional short-recoil designs. It will be noted that all previous gas-operated pistol designs have had very short production lives, having been unsuccessful both commercially and mechanically.

SUMMARY OF THE INVENTION

Therefore, the broad object of the invention is to eliminate the complications and bulk of previous gas-operated mechanisms and to obtain advantages not to be found in recoil-operated mechanisms.

Another object of the invention is to provide an improved breech-locking mechanism wherein a series of projections or lugs carried by the slide are designed to effect the disengagement of the barrel from the bolt when the slide is retracted after the firing of a shot.

A more specific object is to provide such a mechanism wherein projections of the slide are engaged in a corresponding series of inclined grooves in a yoke which moves horizontally with the bolt, but which moves vertically relative to the bolt under the action of the projections which lift the yoke, thereby unlocking the bolt during retraction of the slide, and again locking the bolt when the slide returns to its initial forward firing position.

The invention will now be described with reference to the attached drawing which represents in an illustrative, but not limiting, manner a preferred embodiment of the invention.

BRIEF DESCRIPTION OF THE DRAWING

FIG. 1 shows a detail of the bolt, seen in longitudinal section.

FIG. 2 is the same from above.

FIG. 3 is the same from the side.

FIG. 4 is the section 4—4 of FIG. 1.

FIG. 5 is the elevation of the bolt from direction A in FIG. 1.

FIG. 6 shows the details of the yoke, in longitudinal section.

FIG. 7 is the yoke from below.

FIG. 8 is the side view of the yoke.

FIG. 9 is an elevation of FIG. 6 from direction B.

FIG. 10 is the section 10—10 of FIG. 6.

FIG. 11 is the elevation of FIG. 6 from direction C.

FIGS. 12 and 13 show the slide/yoke/bolt assembly in its forward and retracted positions, respectively.

FIG. 14 is a schematic view, partially sectioned, showing the device of the invention in firing position.

FIG. 15 is a view similar to FIG. 14, but showing the device at the end of its recoil course.

DETAILED DESCRIPTION OF THE PREFERRED EMBODIMENT

The device according to the invention comprises a bolt 1 (FIGS. 1 to 5) whose front part butts against the base of a cartridge lodged in the firing chamber. In the central bore 2 are to be found the firing pin, the extractor, the necessary springs, etc. These are not illustrated because they are understood as conventional.

The bolt 1 has two protruding longitudinal flanges 3, one on each side, that run in horizontal grooves 3' in the slide 11 (FIG. 15), and it can thus move back and forth in the slide but cannot move vertically. The bolt is mounted inside a yoke 4 (FIGS. 6 to 11) which surrounds it on four of its six sides or faces: above, left, right and behind (looking toward the barrel). The front part of the yoke 4 has a tongue 5 which overlaps the breech end of the barrel 12, and which contains a groove that fits over a lug 13 on the barrel. The rear part of the yoke 4 has a lug 6 that fits into a groove or notch 6' in the frame of the pistol, behind the magazine well 18, and locks the rear end of the bolt (FIGS. 14, 15).

The tongue 5 and lug 6 lock the yoke, and consequently the bolt 1, against the breech when the yoke 4 is in the forward and down position shown in FIG. 14. When the bolt 1 is mounted inside the yoke 4, the shoulder or lug 7 on the bolt 1 is seated in the recess or groove 8 carried in the yoke 4, so that the two elements can move vertically relative to each other (if not restrained otherwise), but cannot move horizontally relative to each other.

As can be seen in FIGS. 8, 12 and 13, the yoke 4 has on each side two parallel diagonal grooves 9 that are inclined downwardly from front to rear, and in which run the two pins or lugs 10 protruding from the interior of each side of the slide 11. Horizontal movement of the slide 11 by way of lugs 10, engaged in the inclined grooves 9, is converted into a horizontal and vertical sliding of the yoke 4, by which the position of the slide 11 determines the position of the yoke 4 in whatever point in its travel.

Observing FIG. 14, it can be seen that the barrel 12 at the breech end has at its top part a lug 13 which fits into a corresponding groove in the tongue 5 of the yoke, and which constitutes one of the two locking elements of the mechanism.

The slide 11 in its horizontal movement is guided by corresponding grooves (not illustrated) in the frame of the firearm. It has two horizontal grooves 3', one on each side, in which run the protruding horizontal sections 3 of the bolt 1, described previously.

When the slide 11 is completely retracted (FIG. 13), the yoke 4 is in its most elevated position. When the slide 11 is in the forward position (FIG. 12), the yoke 4 is in the low position, and the bolt 1 is held against the breech (FIG. 14) by tongue 5 and lug 6 which are locked in their respective seats, thus effecting a double locking of the bolt.

The motion of retracting the slide 11 also serves to arm the firing mechanism which contains a spring that has the function of pushing forward the slide 11 into the firing position. The slide can be retracted either by hand or by means of the force exerted on it via the piston 15 and the heel 16 as a result of the passage of gases going through the hole 17 in the barrel 12 upon firing a shot (FIG. 15).

The functioning of the mechanism is extremely simple: As in a conventional pistol, a loaded magazine is inserted in the magazine well 18 and locked in place. The pistol is firmly held in one hand, and the slide 11 is pulled back to the extent of its travel with the other hand. When it is released, the slide travels forward, propelled by the recoil spring, and the bolt 1 pushes a cartridge into the chamber, after which the bolt is locked in place by the yoke 4, ready for firing. At the moment of firing, the bolt is locked in two places, as we have seen previously: the lug 13 on the barrel 12 is locked behind the tongue 5 of the yoke 4, and, simultaneously, the posterior lug 6 of the yoke is held in its mating groove or recess 6' in the frame of the pistol.

When the projectile passes beyond the hole 17 in the barrel 12, a small quantity of gas passes through the hole and impinges on the piston 15 which pushes back the slide 11 by acting on the heel 16, as has been described.

As soon as the slide 11 begins to go back, the yoke 4 rises because of the engagement of the lugs 10 in the lateral oblique grooves 9 in the yoke, but the bolt 1 remains locked in place, providing a rigid support to the base of the cartridge, and supported, in turn, by the yoke which, at this point, can move vertically but not horizontally.

At the instant in which the bullet has left the barrel 12 and the gas pressure has dropped to a safe level, the lug 13 on the barrel and the lug 6 on the yoke are simultaneously freed from their respective seats, and the yoke 4, the bolt 1 and the slide 11 are free to finish the course of their retraction until the position illustrated in FIG. 15 is reached.

The momentum of the slide and any residual pressure continue to propel the slide and its associated components to the limit of their travel, during which time the cartridge case is expelled, the firing mechanism is cocked and another cartridge chambered in the barrel. As soon as the new cartridge is chambered the bolt butts against the cartridge base and stops, while the slide continues forward until it locks the yoke in the down, double-locked position, mentioned previously in describing FIG. 14. At this point the pistol is ready to fire again.

From this it can be seen that the breech-locking mechanism of the invention presents numerous advantages of which the following are the principal ones:

1. It does not utilize a rotary bolt and can thus be made as slim as is consistent with the caliber chosen.

2. Because of the reduced overall dimensions (a pistol designed for the 0.45 CAP cartridge, with a barrel of 100 mm, would have dimensions of approximately 180×125 mm, with 20 mm at the thickest point, excluding slide release, grips and safety), it can be made of steel throughout without a weight penalty, thereby avoiding the manufacturing complications, fragility and buyer resistance of light alloys and plastics.

3. It gives a clean-lined, smooth-contoured pistol, an important functional and commercial consideration.

4. The mechanism is simple in manufacture, operation, disassembly and assembly, and maintenance. It is a 'clean' design, both visually and functionally.

5. The ancillary controls—safety, magazine release, slide release—can be in the same position and operated in the same sense as conventional pistols, thus presenting no problems to anyone familiar with pistols. This is of particular importance to police officers who need a small major-caliber pistol for an off-duty weapon.

6. With the simple substitution of three parts—the barrel/spring assembly, bolt and magazine—it can accomodate any number of other calibers with little or no fitting. One frame, slide and yoke, for example, would be enough for the 0.45 CAP, the 0.38 Super Auto, the 9 mm Parabellum, the 7.65 mm Parabellum and the 7.63 Mauser. The advantage of this, in terms of sales to different countries where different cartridges are in most demand, needs no emphasis.

7. The barrel is fixed and does not recoil independently, which is a great advantage in terms of inherent accuracy. A version could be made in target configuration which would be successful in yet another market.

8. Since the slide is minimally stressed, it is very light (though structurally rigid) and contributes to make the recoil of the pistol tolerable even with heavy calibers, as it lowers the reciprocating weight. It must be emphasized that this is a locked-breech design. In the past some pistols have been made to operate with an unlocked breech ("blowback" operation) with a light slide and correspondingly strong spring. They were difficult to cock manually for the first shot and exhibited poor reliability and durability. There is no point of similarity with the present design.

9. The configuration of the mechanism is such that the cartridges are fed in an almost straight line from the magazine to the chamber, easily enabling the user to utilize bullets of a shape that does not feed dependably in existing pistols without extensive modification.

10. Unlike gas-operated pistols with rotary-bolt locking, in which the locking lugs and corresponding channels have a tendency to become fouled with powder residues, the present design's locking lugs are not adjacent to areas exposed to fouling; therefore, this source of possible malfunction is eliminated.

A preferred embodiment of the invention has been described, but it is to be understood that one may make variations therein which are within the invention's scope which is limited only by the following claims.

I claim:

1. A device for loading and firing a firearm having a barrel (12) mounted in a frame, and a slide (11) reciprocally slidable on the frame in a horizontal path parallel to the longitudinal bore of the barrel, said device comprising:

a plurality of longitudinal grooves (3') in the slide;

a bolt (1) slidably mounted in said longitudinal grooves;

a yoke (4) coupled to the bolt for horizontal longitudinal movement therewith and for vertical movement relative thereto, said bolt being locked by said yoke to the breech of the barrel when the slide is in its forward firing position and the yoke is in its lower position; and follower pin means (10) fixed to the slide and riding in corresponding cam groove means (9) in said yoke for imparting initial vertical upward movement to the yoke to unlock said bolt when the slide is retracted after firing.

2. A device as defined in claim 2 wherein the firearm is a semi-automatic pistol, and further comprising piston means (15), operated by the firing gases, for retracting the slide after firing.

3. A device as defined in claim 1 or 2 further comprising a breech lug (13) on the breech end of the barrel, a tongue (5) at the forward end of the yoke and defining a groove for receiving said lug to lock the front end of said bolt, a downwardly extending rear lug (6) at the rear end of the yoke, and a recess (6') in the frame and matingly configured to the rear lug for receiving same to lock the rear end of said bolt.

4. A device as defined in claim 3 wherein said bolt has upwardly extending shoulders at the front and intermediate portions thereof, which shoulders are received in corresponding recesses in the yoke, thereby permitting vertical movement of the yoke relative to the bolt while preventing relative horizontal movement between said bolt and said yoke.

5. A device as defined in claims 1 or 2 wherein said pin means comprises a plurality of pins projecting transversely from each interior sidewall of the slide, and wherein said groove means comprises a like plurality of inclined grooves in each adjacent outer side surface of said yoke, said grooves being inclined downwardly from the front to the rear of the firearm.

6. A device as defined in claim 3 wherein said pin means comprises a plurality of pins projecting transversely from each interior sidewall of the slide, and wherein said groove means comprises a like plurality of inclined grooves in each adjacent outer side surface of said yoke, said grooves being inclined downwardly from the front to the rear of the firearm.

* * * * *